US006089254A

United States Patent [19]

Kortmann

[11] Patent Number: 6,089,254

[45] Date of Patent: Jul. 18, 2000

[54] SEWER CONSTRUCTION

[76] Inventor: Karl Kortmann, Am Werkshorn 21, 48465 Schuettorf, Germany

[21] Appl. No.: 09/066,410

[22] PCT Filed: Nov. 1, 1996

[86] PCT No.: PCT/EP96/04753

§ 371 Date: May 12, 1998

§ 102(e) Date: May 12, 1998

[87] PCT Pub. No.: WO97/16711

PCT Pub. Date: May 9, 1997

[30] Foreign Application Priority Data

Nov. 2, 1995 [DE] Germany ..... 295 17 313 U

[51] Int. Cl.[7] ..... F16K 23/00

[52] U.S. Cl. ..... 137/312; 137/363; 73/40; 73/46; 73/49.2; 73/37

[58] Field of Search ..... 73/40, 46, 49.2, 73/37; 137/363, 312

[56] References Cited

U.S. PATENT DOCUMENTS

| | | | |
|---|---|---|---|
| 2,398,051 | 10/1946 | Shaw | 73/37 |
| 2,460,054 | 1/1949 | Wiggins | 137/312 |
| 2,737,803 | 3/1956 | Doudera et al. | 73/37 |
| 3,543,453 | 12/1970 | Wright | 137/363 |
| 3,562,969 | 2/1971 | Little | 137/363 |
| 4,023,590 | 5/1977 | Harris et al. | 137/363 |
| 4,373,381 | 2/1983 | Kolp et al. | 73/40.5 R |
| 5,046,354 | 9/1991 | Mungia et al. | 73/49.2 |
| 5,251,472 | 10/1993 | Carlson et al. | 73/46 |
| 5,313,822 | 5/1994 | Bees et al. | 73/37 |
| 5,390,713 | 2/1995 | Fiech | 141/98 |
| 5,419,360 | 5/1995 | Lechevalier | 137/312 |
| 5,505,327 | 4/1996 | Witt | 73/49.2 |
| 5,511,573 | 4/1996 | Corte | 137/312 |
| 5,589,631 | 12/1996 | Spring et al. | 73/49.2 |
| 5,597,948 | 1/1997 | Sharp | 73/49.2 |
| 5,656,766 | 8/1997 | Horn et al. | 73/49.2 |
| 5,939,620 | 8/1999 | Strand | 73/49.2 |
| 5,954,103 | 9/1999 | Smith | 141/86 |

*Primary Examiner*—A. Michael Chambers
*Assistant Examiner*—Thomas L. Mcshane
*Attorney, Agent, or Firm*—Jordan and Hamburg LLP

[57] ABSTRACT

A sewage structure in the form of a drain, inspection shaft or the like, consists particularly of one or several hollow concrete with at least one connection for a sewage pipe. The inventive sewage structure is provided at its inner wall with a contacting form region for supporting a test seal in a fluid-tight test position.

19 Claims, 6 Drawing Sheets

SEWER CONSTRUCTION

The invention relates to a sewage structure, particularly one constructed as a drain, inspection shaft or the like.

BACKGROUND OF THE INVENTION

A sewage structure, known from U.S. Pat. No. 4,373,381 has several hollow concrete parts, the part, which is the upper part in the installed position, accommodating in its test position an air sac as test seal. In this installed position, the test seal is connected over a chain with a sprocket part of the structure. In the pressureless position during the installation of the air sac, the whole of the test device can be shifted into an unwanted inclined position in the hollow concrete part and, under test conditions, with simultaneous action of the test pressure in the interior of the shaft, the danger exists that the test device will become detached in the region of the air sac lying against the wall and, with that, the operating personnel will be exposed to danger.

SUMMARY OF THE INVENTION

It is an object of the invention to provide a sewage structure, the leakproofness of which can be checked rapidly and in an uncomplicated manner with little technical effort for the region of the structure itself, as well as for the region of the sewage pipes, which are connected in each case, the safety requirements being fulfilled at the same time, even when the testing pressures are high.

With the integral contacting form region, the sewage structure, constructed pursuant to the invention, makes possible a defined positioning of the test seal of a testing device in a fluid-tight test position, which makes comprehensive testing possible in one testing process. This decreases the costs of the testing, particularly in the case of an unfinished new construction. With the fixing of the test seal and/or of parts of the testing device over holding regions in the sewage structure, the reliability of the testing is increased.

With respect to important, further advantages and details of the invention, reference is made to the following description and the drawing, in which several embodiments of sewage structures with an inventive contacting profile form are illustrated in greater detail.

IN THE DRAWINGS

FIG. 1 shows a sectional representation of an inlet box with a contacting form region, FIG. 2 shows a sectional representation of an accessible sewage shaft, FIG. 3 shows a sectional representation of a delivery shaft, FIG. 4 shows a sectional representation of a dome shaft FIG. 5 shows a sectional representation of the inlet box, similar to that of FIG. 1, with an internal pipe as contacting form region, FIG. 6 shows a plan view of the inlet box of FIG. 5, FIG. 7 shows a sectional representation of the inlet box, similar to that of FIG. 5, with a modified upper inlet region, and FIG. 8 shows a plan view of the inlet box of FIG. 7 with an inlet grating.

DESCRIPTION OF THE PREFERRED EMBODIMENTS

Figure 1:
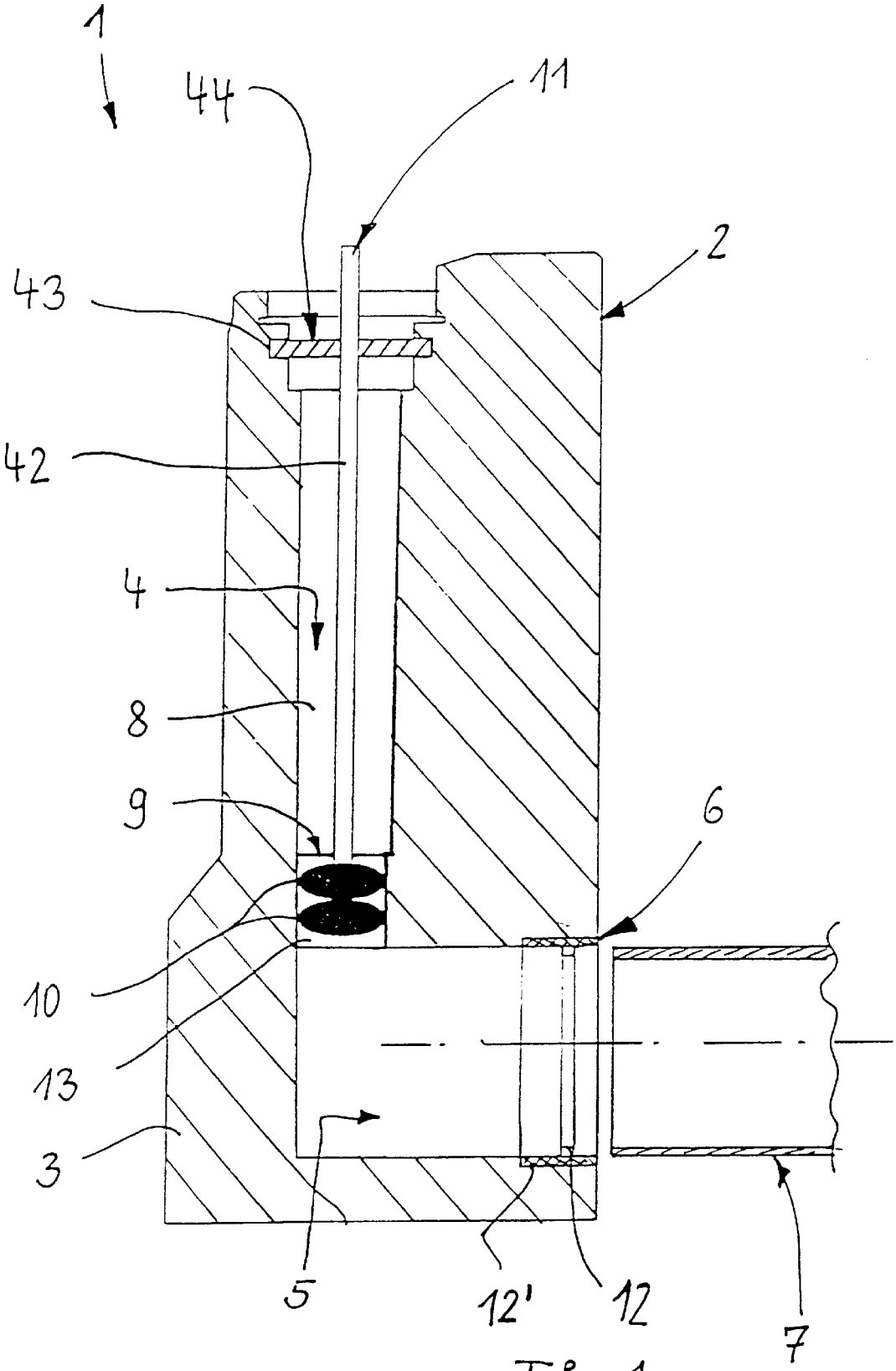

In FIG. 1, a first embodiment of a sewage structure is shown, which is labeled 1 as a whole and forms a drain part 2, for example, for stormwater drains for street and yard or the like. In a lower base region 3, the drain part 2 has a discharging canal 5, in which a collecting canal 4 ends and to which a sewage pipe 7 can be connected in the region of a connecting sleeve 6.

The drain 2 is constructed in one piece as a hollow concrete part and, in the lower part of the inner wall 8 of the collecting canal 4, has a contacting form region 9, which is constructed as a cross sectional narrowing and in which the test seal 10 can be supported in a testing device 11, the details of which are not shown, in a fluid-tight test position (FIG. 1).

To carry out the leakproofness test, the collecting canal 4 is closed off from the surroundings in the seal-accommodating area in such a manner, that a test pressure can be built up in the connecting canal 5 with the help of a pressure medium, such as air or water, and it is possible to establish in a single testing process whether the pipe connection is tight in the region of the connecting sleeve 6, that is, whether the seal 12 seals the connecting surface 12' in the base region 3 as well as the connecting pipe 7. It is self-evident that, during the testing procedure, the end of the sewage pipe 7, which is not visible, is also closed fluid-tight or connected with an assigned shaft component in such a manner, that the whole of the canal system can be tested for groundwater and/or surface water leaks.

In FIG. 1, the contacting form region 9 forms a cylindrical surface 13, against which the test seal 10 can be placed so as to form a seal. It is also possible to provide several contacting form regions 9 (not shown) at a distance from one another, in order to be able to vary the position of the test seal 10. Moreover, the contacting form regions 9 can be constructed with different contours.

Figure 2:
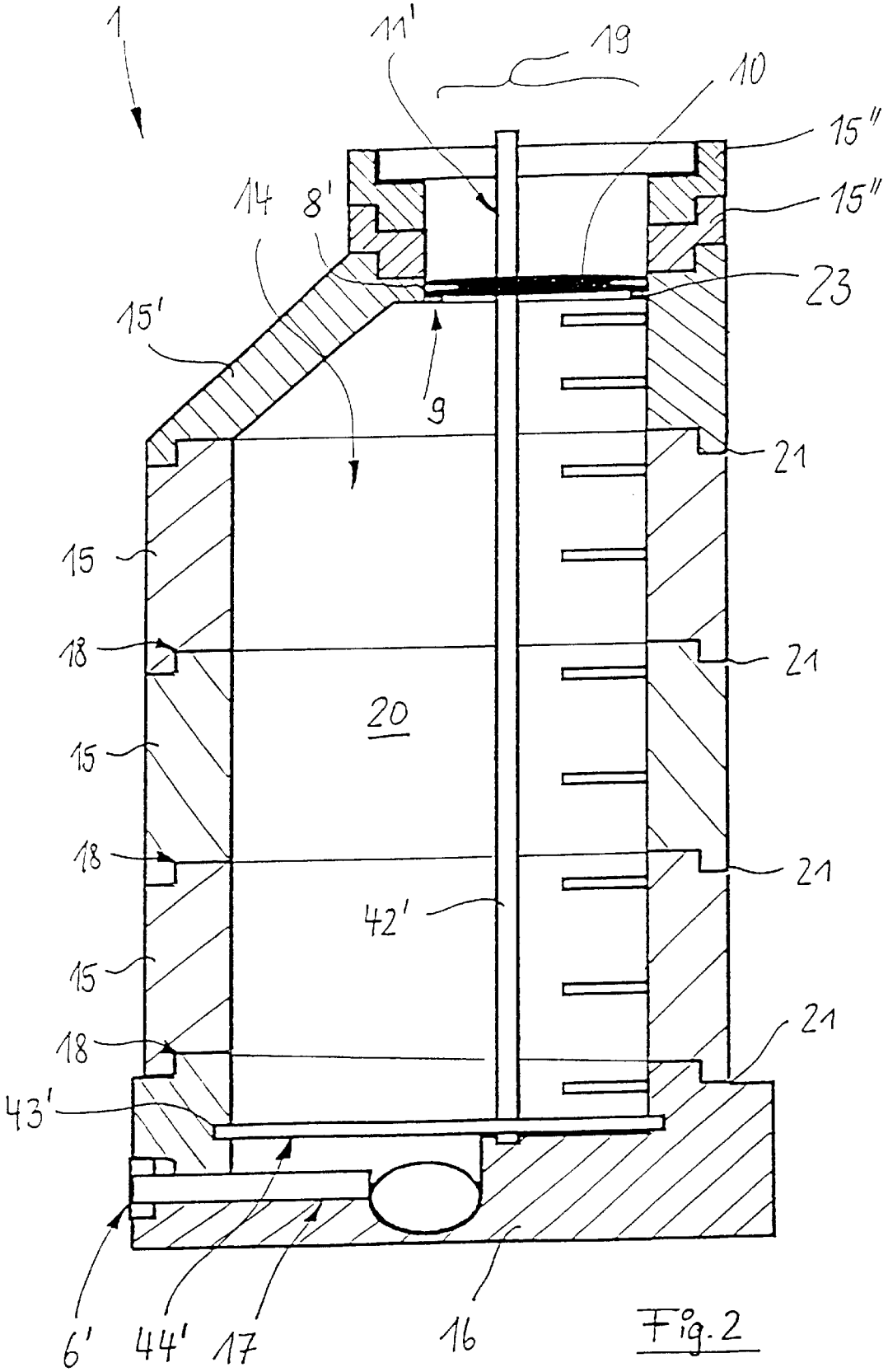

The second embodiment of the sewage structure 1 of FIG. 2 forms an accessible shaft 14, which consists of several essentially identical, ring-shaped hollow concrete parts 15, a bottom plate 16 with a connecting sleeve 6' and a conical part 15', above which ring parts 15' are disposed. At the inner wall 8' of the conical part 15', close to the upper edge of the latter, the contacting form region 9 is formed from a narrow, cylindrical surface and comprises a shoulder 23, which adjoins the cylindrical surface and protrudes inwards and on which the test seal 10 can be placed with additional sealing.

With this arrangement of the contacting form region 9 in the upper shaft region, it is possible to check the whole of the interior space 20 of the shaft 14 and the pipeline network (not shown), connected at 6', for leaks.

Figure 3:
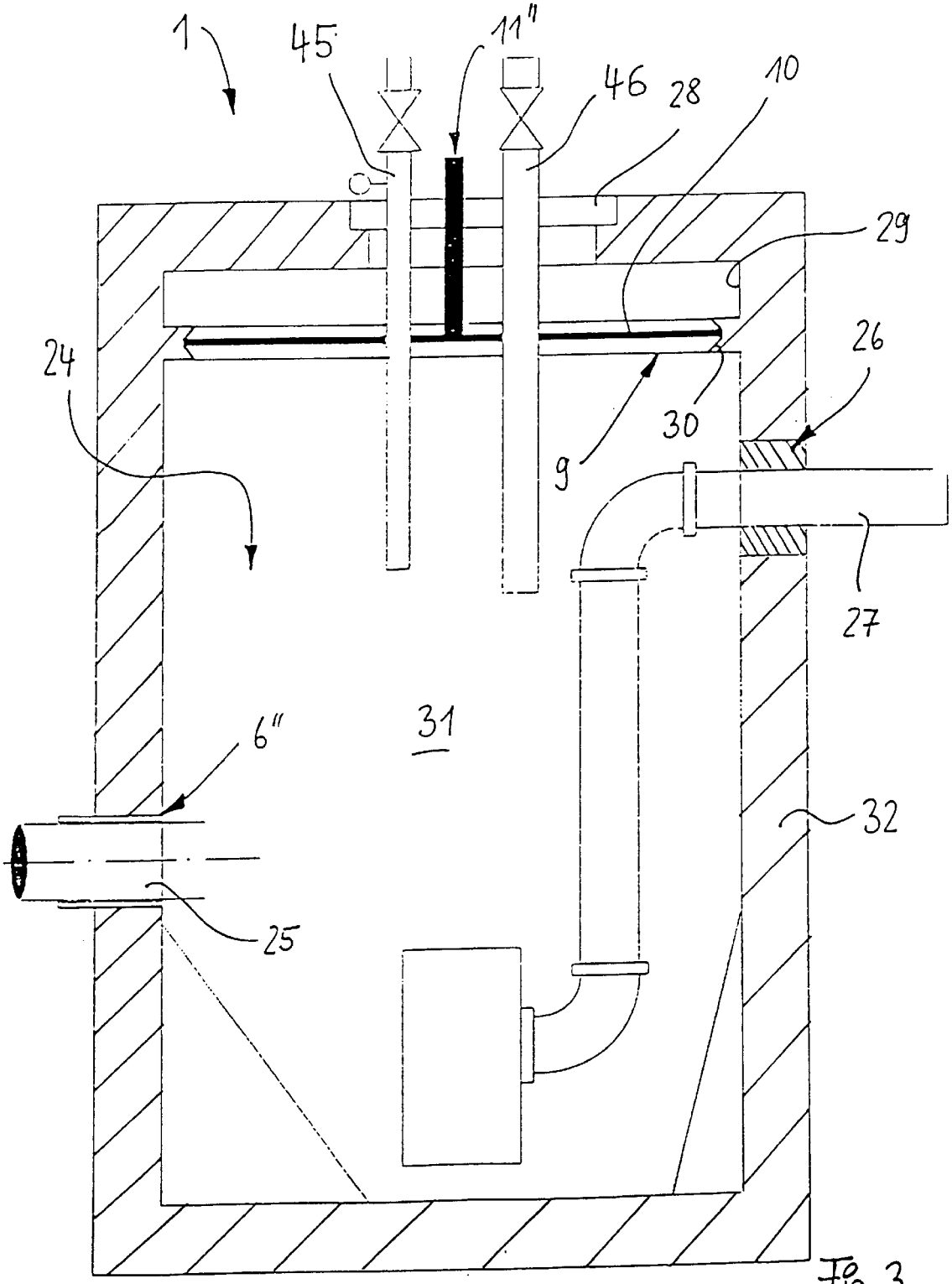

The embodiment of the sewage structure 1 of FIG. 3 forms a delivery shaft 24, which is constructed as a one-piece component and connected at 6" with a feed pipeline 25 and connected to a discharging pipeline 27, which reaches through a seal 26. Close to the cover part 28 of the delivery shaft 24, the inner wall 29 of the latter is provided with the contacting form region 9, which is formed by a ring shoulder with an accommodating groove 30, in which the test seal 10 can be clamped. Likewise, it is conceivable to provide, instead of the groove 30, an undercut (not shown), which supports the test seal, as contacting form region.

Figure 4:
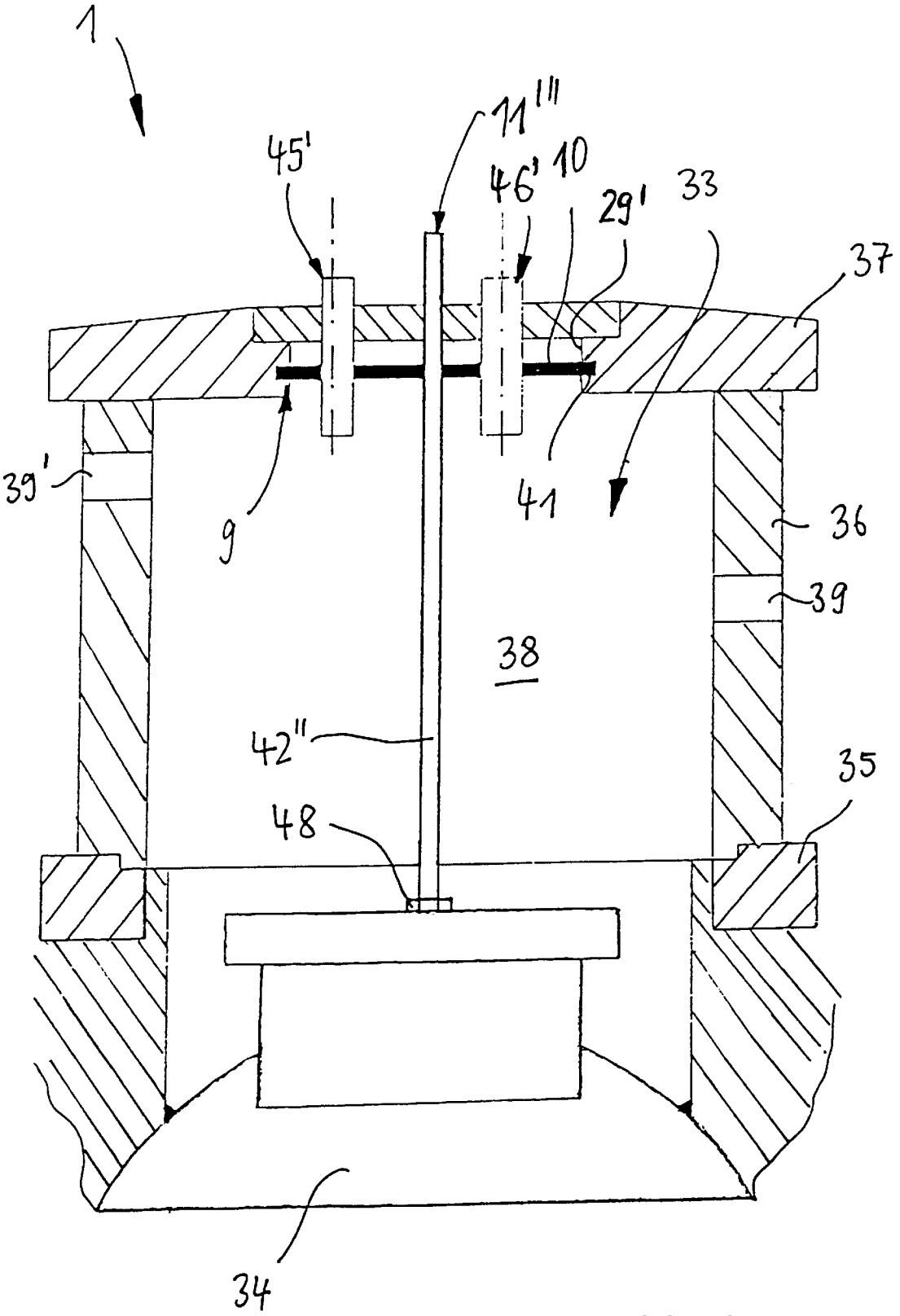
Figure 5:
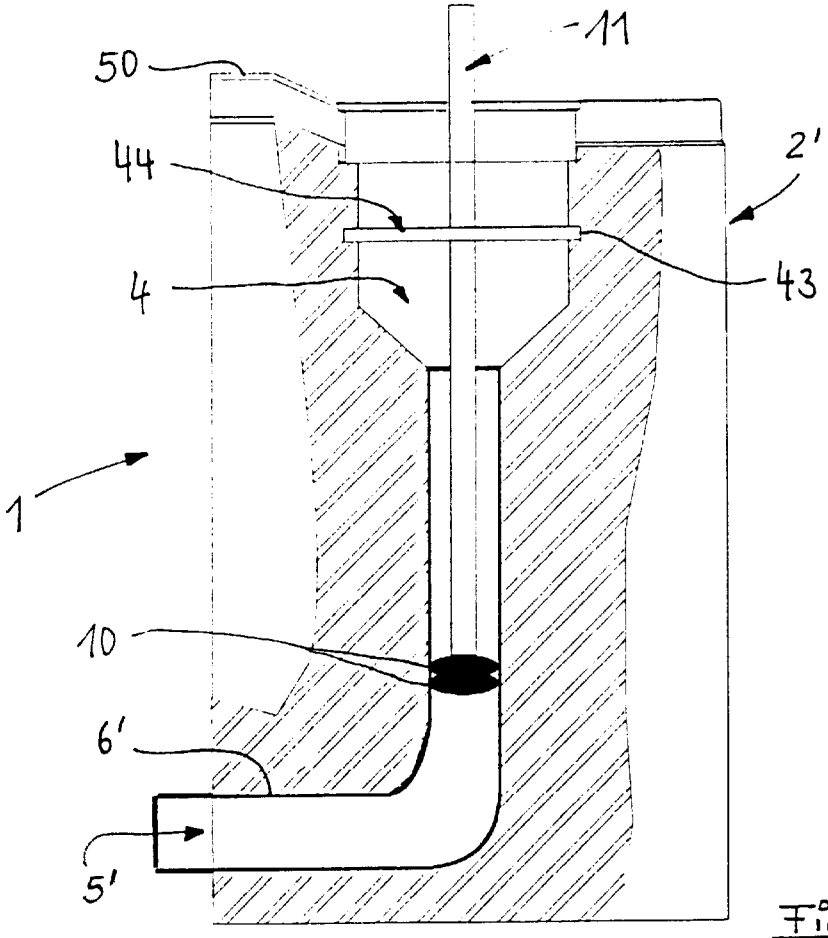
Figure 6:
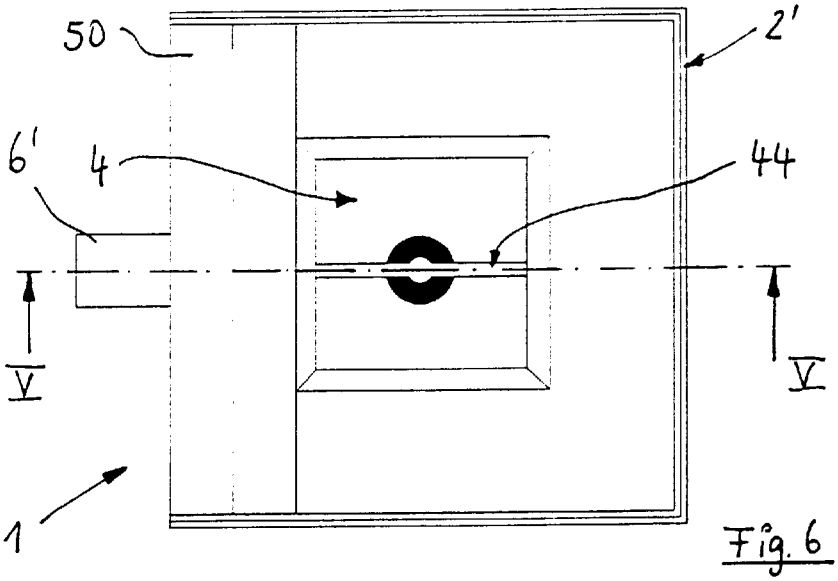
Figure 7:
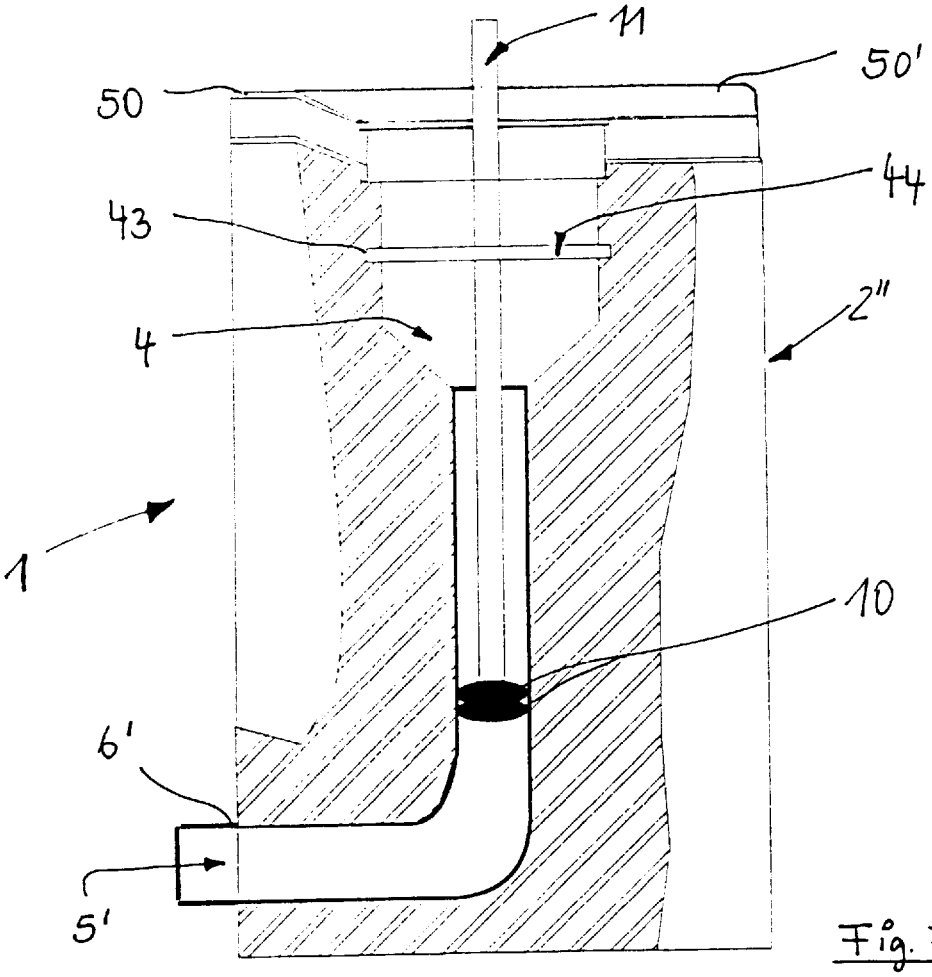
Figure 8:
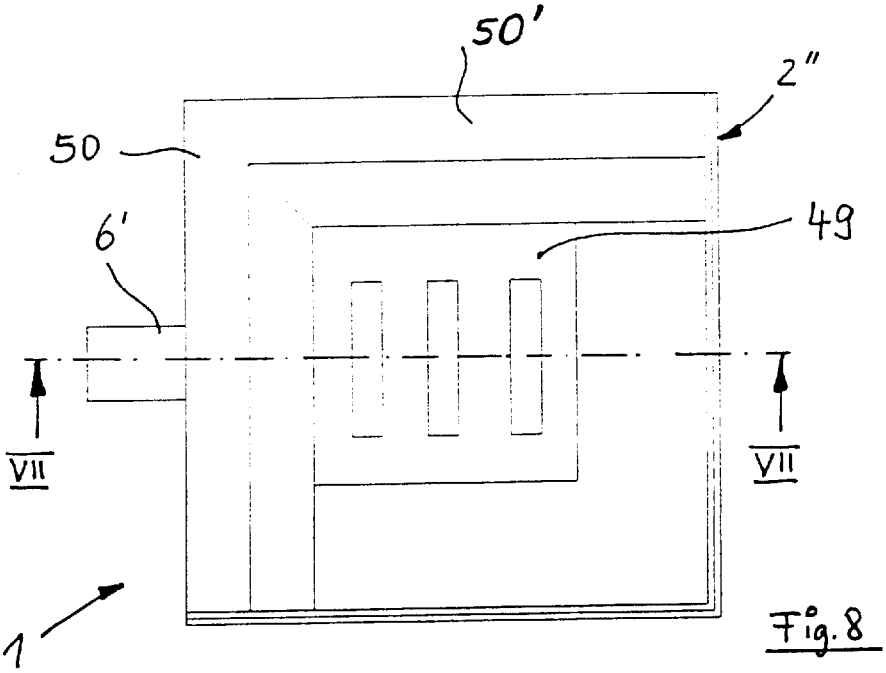

The sewage structure 1, which is constructed, according to FIG. 4, as a dome shaft 33, comprises annular components 35, 36, which are disposed above a tank head 34, and a cover part 37, which encloses the interior of the shaft 38, which must be closed off fluid-tight from the surroundings in the region of connecting openings 39, 39' and in the respective connecting regions of the molded concrete parts 35, 36, 37. For testing for leaks, the contacting profile form 9 is constructed in the cover part 37 at the inner wall 29' of the contacting form region 9, which is formed by an annular groove 41, which can accommodate the test seal 10. The latter can be held permanently in the annular groove 41, for example, by a glued connection or by being cast during the production of the cover parts 37 and make possible repetitions of the leak test, for example, during a routine check-up of the dome shaft 33.

The sewage structures 1 can be provided with additional holding regions for fixing the testing device 11 during the testing process, for example, in the form of recesses or protrusions, so that the testing device 11 is held securely in position when acted upon by pressure.

In FIG. 1, the testing device 11 has a pipe section 42, which is provided for supplying a pressure medium and as a holding part for the test seal 10, which can be fixed in the upper edge region of the collecting canal 4 by a securing part 44 engaging a groove 43 as holding region. In FIG. 2, the testing device 11' can be fixed by a securing part 44' engaging a groove 43' in a bottom plate 16. In FIG. 3, the testing device 11" is held by the test seal 10, which can be fixed in the accommodating groove 30, and the pressure medium can be brought over feeds 45 or 46 into the interior. In the case of the embodiment of FIG. 4, the testing device 11'" can be fixed at the tank head in a connecting region 48.

In FIGS. 5 to 8, the drain part 2' is shown in a second embodiment with different surface contour 50, 50', the inner discharging canal 5' being formed by an inner pipe 6', into which the test seal 10 can be brought into the fluid-tight test position. Moreover, the testing device 11, after removal of the inlet grating 49 (FIG. 8), is supported at the rod-shaped securing part 44, which engages the edge of the groove 43.

In principle, the sewage structure 1 can have any design and fulfill different functions and be constructed, for example, as an electric shaft, a cable distributing shaft or an equipment shaft, the use of plastic or metal as a material of construction for the shaft structure or its individual parts also being conceivable.

The contacting form regions can be circular in horizontal cross section. Instead of that, however, they can also be angular or constructed in any configuration desired.

What is claimed is:

1. A sewer unit, comprising:

a sewer structure having at least one concrete hollow part and at least one sewer conduit connected to said hollow part, said sewer structure having an inner wall presenting a support region; and a test seal disposable on said support region in a fluid-tight relationship to thereby enable testing of said sewer structure for fluid tightness.

2. A sewer structure according to claim 1 further comprising spaced support regions on said inner wall.

3. A sewer structure according to claim 1 wherein said at least one concrete hollow part is formed by concrete sections disposed one on top of the other to enclose a hollow interior having an upper portion, said support region being disposed at said upper portion.

4. A sewer structure according to claim 1 wherein said support region has a cross sectional configuration which contacts a contacting section of said test seal, said contacting section of said test seal having a cross sectional configuration which is substantially the same as said cross sectional configuration of said support region.

5. A sewer structure according to claim 1 wherein said support region includes at least one groove for accommodating said test seal.

6. A sewer structure according to claim 1 comprising test seals disposed on said support region with a fluid-tight relationship.

7. A sewer structure according to claim 1 wherein said test seal includes a holder for holding said test seal on said sewer structure such that said test seal is in a position to engage said support region in a fluid tight manner.

8. A sewer unit according to claim 1 wherein said test seal includes a sealing part and a holder, said holder contacting said sewer structure and holding said sealing part on said support region in a fluid-tight relationship.

9. A sewer unit according to claim 1 wherein said test seal includes an engageable portion for engaging said support region and a holder connected to said engageable portion and holding said engageable portion on said support region in a fluid-tight relationship.

10. A sewer unit according to claim 1 wherein said test seal includes an elongated part connected to said engageable portion and a mounting part for mounting said elongated part on said sewer structure.

11. A sewer unit according to claim 10 wherein said elongated part comprises a conduit for supplying a pressure medium to said engageable portion.

12. A sewer unit according to claim 1 wherein said test seal includes a pressure medium-supported engageable portion for engaging said support region and a conduit for supplying a pressure medium to said engageable portion, said test seal further comprising a mounting holder spaced from said engageable portion, said mounting holder for holding said conduit in a fixed position on said sewer structure.

13. A sewer unit, comprising a sewer structure including an interconnected network of concrete hollow parts and sewage drainage conduits, at least one inner wall on said sewer structure, a support region on said at least one inner wall, and a test seal disposable on said support region in a fluid-tight manner such that the fluid tightness of substantially the entire interconnected network can be simultaneously tested.

14. A sewer unit according to claim 13 wherein said test seal includes an engageable portion for engaging said support region and a holder connected to said engageable portion and holding said engageable portion on said support region in a fluid-tight relationship.

15. A sewer unit according to claim 13 wherein said test seal includes an elongated part connected to said engageable portion and a mounting part mounting said elongated part on said sewer structure.

16. A sewer unit according to claim 15 wherein said elongated part comprises a conduit for supplying a pressure medium to said engageable portion.

17. A sewer unit according to claim 13 wherein said test seal includes a pressure medium-supported engageable portion engaging said support region and a conduit for supplying a pressure medium to said engageable portion, said test seal further comprising a mounting holder spaced from said engageable portion, said mounting holder holding said conduit in a fixed position on said sewer structure.

18. A sewer unit, comprising a sewer structure having at least one hollow part and at least one sewer conduit connected to said at least one hollow part, said at least one hollow part having at least one inner wall having a support region, and means supported on said sewer structure for effecting a fluid-tight relationship with said support region to thereby enable testing of said sewer structure for fluid tightness.

19. A sewer unit, comprising a sewer structure having at least one sewer conduit connected to said at least one hollow part, said at least one hollow part having at least one inner wall having a support region, a pressure medium-supplied test seal disposed in a position to provide a fluid tight relationship with said support region, and means for supporting said test seal in said position and for supplying a pressure medium to said test seal.

* * * * *